US007579306B2

(12) United States Patent
Costello et al.

(10) Patent No.: US 7,579,306 B2
(45) Date of Patent: Aug. 25, 2009

(54) METHOD FOR IMPROVING THE OXIDATIVE STABILITY OF INDUSTRIAL FLUIDS

(75) Inventors: Michael T. Costello, Cheshire, CT (US); Igor Riff, Skillman, NJ (US); Rebecca F. Seibert, Oxford, CT (US)

(73) Assignee: Chemtura Corporation, Middlebury, CT (US)

( * ) Notice: Subject to any disclaimer, the term of this patent is extended or adjusted under 35 U.S.C. 154(b) by 570 days.

(21) Appl. No.: 11/360,837

(22) Filed: Feb. 22, 2006

(65) Prior Publication Data

US 2006/0199748 A1 Sep. 7, 2006

Related U.S. Application Data

(60) Provisional application No. 60/657,395, filed on Mar. 2, 2005.

(51) Int. Cl.
*C10M 101/04* (2006.01)
*C10M 105/34* (2006.01)

(52) U.S. Cl. ..... 508/449; 508/579; 508/580

(58) Field of Classification Search ..... 508/449, 508/579, 580

See application file for complete search history.

(56) References Cited

U.S. PATENT DOCUMENTS 2,900,342 A * 8/1959 Cook et al. ..... 508/304
4,244,829 A * 1/1981 Coupland et al. ..... 508/304
6,362,138 B1 * 3/2002 Camenzind et al. ..... 508/273
6,531,429 B2 3/2003 Fletschinger et al.
6,583,302 B1 6/2003 Erhan et al.
2002/0098989 A1 * 7/2002 Heimann et al. ..... 508/136

OTHER PUBLICATIONS

J. A. Bukowski, "Review of Respiratory Morbidity from Occupational Exposure to Oil Mists," Applied Occupational and Environmental Hygiene, 18:828-837 (2003).
J. Flider, "Use of rapeseed oil in lubricants," INFORM 6(9):1031-1035 (Sep. 1995).
Xuedong, Wu et al., "The Study of Epoxidized Rapeseed Oil Used as a Potential Biodegradable Lubricant," JAOCS 77(5):561-563 (May 2000).
A. Adhvaryu et al., "Epoxidized soybean oil as a potential source of high-temperature lubricants," Industrial Crops and Products 15:247-254 (2002).
D. Clark et al., "New Generation of Ashless Top Tier Hydraulic Fluids," Lubrication Engineering, 22-31 (Apr. 2000).
K.P. Kovanda et al., "Polyether Polyol: An Interim Look Inside the Lead Pump on a Hydraulic Automatic Gauge Control System," Lubrication Engineering, 25-29 (Nov. 2000).
C. Duncan et al., "Ashless Additives and New Polyol Ester Base Oils . . . for Use in Biodegradable Hydraulic Fluid Applications," Lubrication Engineering, 18-28 (Sep. 2002).
L.J. Patin et al., "Biodegradable & Fire-Resistant Hydraulic Fluids: Now You Can Have Both," Lubricants World, 26-29 (Nov. 2002).

* cited by examiner

*Primary Examiner*—Glenn A Caldarola
*Assistant Examiner*—Taiwo Oladapo
(74) *Attorney, Agent, or Firm*—Jaimes Sher

(57) ABSTRACT

An oxidatively stable biodegradable industrial fluid is disclosed, wherein the industrial fluid is comprised of an epoxidized vegetable oil or synthetic ester in combination with at least one antioxidant. A method for improving the oxidation stability of industrial fluids is also disclosed and comprises employing as the base oil of said hydraulic fluid an epoxidized synthetic ester in combination with at least one antioxidant.

11 Claims, No Drawings

METHOD FOR IMPROVING THE OXIDATIVE STABILITY OF INDUSTRIAL FLUIDS

We claim the benefit under Title 35, United States Code, § 120 to U.S. Provisional Application No. 60/657,395, filed Mar. 2, 2005, entitled METHOD FOR IMPROVING THE OXIDATIVE STABILITY OF HYDRAULIC FLUIDS.

BACKGROUND OF THE INVENTION

1. Field of the Invention

The present invention relates to industrial fluids. More particularly, the present invention relates to improved hydraulic fluids that exhibit oxidative stability, ready biodegradability, low volatility, and a high viscosity index.

2. Description of Related Art

In recent years, there has been a strong trend in the U.S. and Europe to develop a readily biodegradable, low volatility, and high viscosity index industrial fluid. This desire for an environmentally friendly natural ester fluid is driven by a variety of factors, including a belief in the green movement that natural ester fluids are renewable resources that have less impact on the carbon cycle balance and a belief that the biodegradability of these fluids makes disposal costs less of an issue Additionally, there has been a drive in the metalworking industry to dramatically lower the threshold limit value (TLV) for mineral oil mists. Although there is currently no substantive evidence that oil mist exposure has any effects on machinists' long term respiratory health, the American Conference of Governmental Industrial Hygienists (ACGIH) has proposed a TLV of 0.2 $mg/m^3$ which is a 25-fold reduction from the previous TLV of 5 $mg/m^3$ (see J. A. Bukowski, Applied Occupational and Environmental Hygiene, 18:828-837 2003)). With such increased pressure to remove oil from the workplace, there is a corresponding increase in interest in finding alternative basestocks.

A number of articles have been published showing it to be feasible to use canola and rapeseed oils as industrial fluids. Owing to their low oxidative stability, however, a large amount of antioxidant is required to protect these vegetable oils, which precludes their widespread use in industry. In particular, polyunsaturate levels above 2-3% result in polymerization cross-linking, as well as oxidative and biological degradation during product use. Additionally, these glycerides are hydrolytically unstable for most applications where lubricant life is expected to be weeks, months, or years. Typically, unless severe steps are taken to control microbial growth, the monounsaturates (e.g., oleates) are biodegraded far too rapidly for use in emulsion applications.

Attempts have been made to reduce the amount of polyunsaturated fatty material, and thereby the instability, by increasing the oleic acid content, either by hydrogenation followed by fractionation or by genetically engineering the crops. For example, in the production of high erucic (oleic) acid rapeseed (HEAR) oil, the percentage of two and three double bond fatty acids (i.e., linoleic and linolenic) is reduced to very low levels. As a result, HEAR oil possesses a high oxidative stability, which produces smaller deposits upon heating. Unfortunately, the extra processing that is necessary to improve the performance can more than double the cost of these products.

U.S. Pat. No. 6,531,429 discloses compositions comprising thiophosphoric acid esters and dithiophosphoric acid esters or phosphoric acid thioesters and oil additives from the group of the polyol partial esters, amines and epoxides, and also to the use of those lubricant compositions in improving the performance properties of lubricants, such as greases, metal-working fluids, gear fluids or hydraulic fluids. Thiophosphoric acid esters and dithiophosphoric acid esters or phosphoric acid thioesters are present in the compositions preferably in a concentration of less than 400 ppm.

U.S. Pat. No. 6,583,302 discloses the modification of triglyceride oils having unsaturated fatty acid substituents to convert sites of unsaturation to $C_2$ to $C_{10}$ diesters. The resulting derivatives are said to be characterized by thermal and oxidative stability, have low temperature performance properties, are environmentally-friendly, and have utility as hydraulic fluids, lubricants, metal working fluids and other industrial fluids. The triglyceride oils are most easily prepared via epoxidized vegetable oils which are converted to the diesters in either a one- or two-step reaction.

Flider, F. J., *INFORM* 6(9):1031-1035 (September, 1995) reported that although there is no one universal vegetable oil that can be used in all lubricant applications, both HEAR oil and canola oil economically and efficaciously meet the requirements of a broad cross-section of the lubricants industry. The author predicted that through continuing advances in traditional plant breeding and genetic engineering, an even wider range of rapeseed oils with functionalities and performance characteristics that meet the burgeoning demands of the lubricant industry would be developed.

Wu, X. et al., *JAOCS* 77(5):561-563 (May, 2000) described the application of epoxidized rapeseed oil as a biodegradable lubricant. They found that epoxidation treatment had no adverse effect on the biodegradability of the base stock and that the epoxidized oil had superior oxidative stability compared to rapeseed oil based on the results of both oven tests and rotary oxygen bomb tests and better friction-reducing and extreme pressure abilities according to tribological investigations. Moreover, the oxidative stability could be dramatically promoted by the addition of a package of antioxidants. Formation of a tribopolymerization film was proposed as an explanation of the tribological performance of epoxidized rapeseed oil.

Adhvaryu, A. et al., *Industrial Crops and Products* 15:247-254 (2002) demonstrated the improved performance of epoxidized soybean oil (ESBO) over soybean oil (SBO) and genetically modified high oleic soybean oil (HOSBO) in certain high temperature lubricant applications. They validated the thermal and deposit forming tendencies of these oils using micro-oxidation and differential scanning calorimetry in conjunction with identification of oxidized products by infrared spectroscopy and also discussed the function of phenolic antioxidants in these oils. Boundary lubrication properties under high load and low speed were determined and the variations explained based on the structural differences of these vegetable oils.

The disclosures of the foregoing are incorporated herein by reference in their entirety.

SUMMARY OF THE INVENTION

Another approach to diminishing sediment formation and increasing oxidative stability is to epoxidize the polyunsaturated oil, e.g., epoxidized canola oil (ECO). Currently, a large amount of antioxidant is required to protect vegetable oil. However, owing to the added stability of the epoxide linkage, a smaller amount of antioxidant is required to stabilize ECO as compared to conventional vegetable oils. Additionally, while the price of ECO is higher than conventional canola oil, it is far less than HEAR.

The present invention is directed to using an epoxidized vegetable oil or synthetic ester to make an oxidatively stable biodegradable industrial fluid wherein said fluid is used in combination with at least one antioxidant. In the present context, an industrial fluid is defined as any of a class of biodegradable oils used for automotive engine oils, two-stroke engine oils, aviation turbine oils, automotive gear oils, industrial gear oils, hydraulic fluids, compressor oils, metal-working fluid, textile oils, chain saw oils, and greases.

More particularly, the present invention is directed to a biodegradable industrial fluid comprising an epoxidized vegetable oil and at least one antioxidant.

In a preferred embodiment, the present invention is directed to a hydraulic fluid comprising an epoxidized tall oil ester and at least one antioxidant.

In another aspect, the present invention is directed to a method for improving the oxidation stability of industrial fluids comprising employing as the base oil of said industrial fluid an epoxidized synthetic ester, wherein said ester is used in combination with at least one antioxidant. Preferably, the industrial fluid is a hydraulic fluid.

DESCRIPTION OF THE PREFERRED EMBODIMENT(S)

The tall oil employed in the practice of the present invention can be esterified either before or after it is epoxidized. The alkyl moiety of the ester portion preferably comprises from one to about eighteen carbon atoms, e.g., methyl, ethyl, propyl, butyl, pentyl, hexyl, heptyl, octyl, nonyl, decyl, undecyl, dodecyl, tridecyl, tetradecyl, pentadecyl, hexadecyl, heptadecyl, octadecyl, isomers of the foregoing, and the like. Preferably, the alkyl moiety of the ester group, including isomers, comprises from four to eight carbon atoms. More preferably, the alkyl moiety is 2-ethylhexyl, i.e., an isomer of octyl.

Esterification and epoxidation of the tall oil can be carried out by methods well-known to those skilled in the art.

Examples of antioxidants that can be used in the practice of the present invention include alkylated diphenylamines and N-alkylated phenylenediamines. Secondary diarylamines are well known antioxidants and there is no particular restriction on the type of secondary diarylamine that can be used in the practice of the present invention. Preferably, the secondary diarylamine antioxidant is of the general formula $R_{11}$—NH—$R_{12}$, where $R_{11}$ and $R_{12}$ each independently represent a substituted or unsubstituted aryl group having 6 to 46 carbon atoms. Illustrative of substituents for the aryl group are aliphatic hydrocarbon groups such as alkyl having 1 to 40 carbon atoms, hydroxyl, carboxyl, amino, N-alkylated amino, N',N-dialkylated amino, nitro, or cyano. The aryl is preferably substituted or unsubstituted phenyl or naphthyl, particularly where one or both of the aryl groups are substituted with alkyl, such as one having 4 to 24 carbon atoms. Preferred alkylated diphenylamines that can be employed in the practice of the present invention include nonylated diphenylamine, octylated diphenylamine (e.g., di(octylphenyl) amine), styrenated diphenylamine, octylated styrenated diphenylamine, and butylated octylated diphenylamine.

The alkyl moiety of 1 to 40 carbon atoms can have either a straight or a branched chain, which can be either a fully saturated or a partially unsaturated hydrocarbon chain, e.g., methyl, ethyl, propyl, butyl, pentyl, hexyl, 2-ethyl hexyl, heptyl, octyl, nonyl, decyl, undecyl, dodecyl, tridecyl, tetradecyl, pentadecyl, hexadecyl, heptadecyl, octadecyl, oleyl, nonadecyl, eicosyl, heneicosyl, docosyl, tricosyl, tetracosyl, pentacosyl, tricontyl, pentatriacontyl, tetracontyl, and the like, and isomers and mixtures thereof.

Examples of some secondary diarylamines that can be employed in the practice of the present invention include: diphenylamine, dialkylated diphenylamine, trialkylated diphenylamine, or mixtures thereof, 3-hydroxydiphenylamine, 4-hydroxydiphenylamine, N-phenyl-1,2-phenylenediamine, N-phenyl-1,4-phenylenediamine, mono- and/or di-butyldiphenylamine, mono- and/or di-octyldiphenylamine, mono- and/or di-nonyldiphenylamine, phenyl-α-naphthylamine, phenyl-β-naphthylamine, di-heptyldiphenylamine, mono- and/or di-(α-methylstyryl)diphenylamine, mono- and/or di-styryldiphenylamine, N,N'-diisopropyl-p-phenylenediamine, N,N'-bis(1,4-dimethylpentyl)-p-phenylenediamine, N,N'-bis(1-ethyl-3-methylpentyl)-p-phenylenediamine, N,N'-bis(1-methylheptyl)-p-phenylenediamine, N,N'-diphenyl-p-phenylenediamine, N,N'-di-(naphthyl-2)-p-phenylenediamine, N-isopropyl-N'-phenyl-p-phenylenediamine, N-(1,3-dimethylbutyl)-N'-phenyl-p-phenylenediamine, N-(1-methylpentyl)-N'-phenyl-p-phenylenediamine, N-cyclohexyl-N'-phenyl-p-phenylenediamine, 4-(p-toluenesulfonamido)diphenylamine, 4-isopropoxydiphenylamine, tert-octylated N-phenyl-1-naphthylamino, and mixtures of mono- and dialkylated t-butyl-t-octyldiphenylamines.

Another example of the antioxidant types that can be used in the practice of the present invention is the hindered phenolic type. As illustrative of oil soluble phenolic compounds, may be listed alkylated monophenols, alkylated hydroquinones, hydroxylated thiodiphenyl ethers, alkylidenebis phenols, benzyl compounds, acylaminophenols, and esters and amides of hindered phenol-substituted alkanoic acids. In a preferred embodiment of the present invention, 3,5-di-t-butyl-4-hydroxy-hydrocinnamic acid, a $C_7$-$C_9$ branched alkylester of 2,6-di-t-butyl-p-cresol, and mixtures thereof are included in the hydraulic fluid compositions.

Another example of an antioxidant type that can be used in combination with the additives of the present invention are oil soluble copper compounds, and the like.

The following are exemplary of such additives and are commercially available from Chemtura Corporation: Naugalube® 438, Naugalube 438L, Naugalube 640, Naugalube 635, Naugalube 680, Naugalube AMS, Naugalube APAN, Naugard® PANA, Naugalube TMQ, Naugalube 531, Naugalube 431, Naugard BHT, Naugalube 403, and Naugalube 420, among others.

Preferred antioxidants that can be used in the practice of the present invention are listed below with a brief description of their chemistry.

Description of Antioxidants

| Trade Designation | Description |
|---|---|
| AX 15 | Thiodiethylene-bis(3,5-di-t-butyl-4-hydroxyhydrocinnamate |
| BHT | 2,6-di-t-butyl hydroxytoluene |
| Butylated DPA | butylated (45%) octylated (19%) diphenylamine |
| Naugalube APAN | octylated phenyl-α-naphthylamine |
| Naugalube 438L | mono-, di-, and tri-, nonylated DPA |
| Naugalube 531 | 3,5-di-t-butyl-4-hydroxy-hydrocinnamic acid $C_7$-$C_9$ branched alkyl ester |
| Naugalube 640 | butylated (30%) octylated (24%) diphenylamine |

The base oil and antioxidants of the hydraulic fluids of this invention can be used in combination with other additives typically found in hydraulic and other industrial fluids, and such combinations may, in fact, provide synergistic effects toward improving the desired properties, such as improved deposit control, anti-wear, frictional, antioxidant, low temperature, and like properties, of the fluid. Typical additives found in hydraulic fluids include dispersants, detergents, rust inhibitors, antiwear agents, antifoamants, friction modifiers, seal swell agents, demulsifiers, VI improvers, and pour point depressants.

Examples of dispersants include polyisobutylene succinimides, polyisobutylene succinate esters, Mannich Base ashless dispersants, and the like.

Examples of detergents include metallic alkyl phenates, sulfurized metallic alkyl phenates, metallic alkyl sulfonates, metallic alkyl salicylates, and the like.

Examples of anti-wear additives include organo borates, organo phosphites, organic sulfur-containing compounds, zinc dialkyl dithiophosphates, zinc diaryl dithiophosphates, phosphosulfurized hydrocarbons, and the like.

Examples of friction modifiers include fatty acid esters and amides, organo molybdenum compounds, molybdenum dialkylthiocarbamates, molybdenum dialkyl dithiophosphates, and the like.

An example of an antifoamant is polysiloxane, and the like. An example of a rust inhibitor is polyoxyalkylene polyols, and the like. Examples of VI improvers include olefin copolymers and dispersant olefin copolymers, and the like. An example of a pour point depressant is polymethacrylate, and the like.

Compositions, when containing these additives, typically are blended into the base oil in amounts that are effective to provide their normal attendant function. Representative effective amounts of such additives are illustrated as follows:

| Compositions | Broad Wt % | Preferred Wt % |
|---|---|---|
| V.I. Improver | 1-12 | 1-4 |
| Corrosion Inhibitor | 0.01-3 | 0.01-1.5 |
| Oxidation Inhibitor | 0.01-5 | 0.01-1.5 |
| Dispersant | 0.1-10 | 0.1-5 |
| Lube Oil Flow Improver | 0.01-2 | 0.01-1.5 |
| Detergents and Rust Inhibitors | 0.01-6 | 0.01-3 |
| Pour Point Depressant | 0.01-1.5 | 0.01-0.5 |
| Anti-Foaming Agents | 0.001-0.1 | 0.001-0.01 |
| Antiwear Agents | 0.001-5 | 0.001-1.5 |
| Seal Swellant | 0.1-8 | 0.1-4 |
| Friction Modifiers | 0.01-3 | 0.01-1.5 |
| Base Oil | Balance | Balance |

When additional additives are employed, it may be desirable, although not necessary, to prepare additive concentrates comprising concentrated solutions or dispersions of the subject additives whereby several additives can be added simultaneously to the base oil to form the hydraulic fluid composition. Dissolution of the additive concentrate into the tall oil may be facilitated by solvents and by mixing accompanied with mild heating, but this is not essential. The concentrate or additive-package will typically be formulated to contain the additives in proper amounts to provide the desired concentration in the final formulation when the additive-package is combined with a predetermined amount of base lubricant. Thus, the additives can be added to small amounts of base oil or other compatible solvents to form additive-packages containing active ingredients in collective amounts of typically from about 2.5 to about 90%, and preferably from about 15 to about 75%, and most preferably from about 25 to about 60% by weight additives in the appropriate proportions with the remainder being base oil. The final formulations may employ typically about 1-20 wt. % of the additive-package with the remainder being base oil.

All of the weight percents expressed herein (unless otherwise indicated) are based on active ingredient (AI) content of the additive, and/or upon the total weight of any additive-package or formulation, which will be the sum of the (AI) weight of each additive plus the weight of total oil or diluent.

In general, the preferred hydraulic fluid compositions of the invention contain the additives in a concentration ranging from about 0.01 to about 30 weight percent. A concentration range for the additives ranging from about 0.01 to about 10 weight percent based on the total weight of the composition is preferred. A more preferred concentration range is from about 0.2 to about 5 weight percent.

The advantages and the important features of the present invention will be more apparent from the following examples.

EXAMPLES

Descriptions of fatty acid distributions of the vegetable oils employed herein are given in Table 1. Descriptions of the epoxidized vegetables and their iodine values (degree of unsaturation) are listed in Table 2. In the examples the detergents used were 400 TBN amorphous overbased calcium sulfonate (Calcinate C400CLR), 300 TBN amorphous overbased calcium sulfonate (Calcinate C300R), 400 TBN crystalline overbased calcium sulfonate (Calcinate C400W), and overbased calcium carboxylate (OBC), the antioxidants used were nonylated diphenyl amine (Naugalube 438L), 3,5-di-t-butyl-4-hydroxy-hydrocinnamic acid $C_7$-$C_9$ branched alkyl ester (Naugalube 531), alkylated phenyl-alpha-naphthylamine (Naugalube APAN) and a tolutriazole derivative (Metal Passivator) and the EP/AW additives used were zinc dialkyldithiophosphate (ZDDP), sulfurized fatty acids (RC 2515), and glycerol monooleate (GMO).

TABLE 1

Description of Vegetable Oils and Esters

| Name | Description | C16-0 | C18-0 | C18-1 | C18-2 | C18-3 | C22-1 | other |
|---|---|---|---|---|---|---|---|---|
| SO | Soybean Oil | 10 | 2 | 29 | 51 | 7 | | 1 |
| CO1 | Canola Oil | 5 | 2 | 61 | 21 | 9 | | 2 |
| CO2 | Canola Oil, high oleic | 4 | 2 | 85 | 7 | | | 2 |
| CO3 | Canola Oil | | | 60 | | | | 32 |
| HEAR1 | High Erucic Acid Rapeseed Oil | | | | | | 51 | 49 |
| HEAR2 | High Erucic Acid Rapeseed Oil | | | | | | 45 | 55 |
| OTE | 2-ethylhexyl tallate | | | | | | | 100 |
| POE | trimethylol propane caprate | | | | | | | 100 |

C16-0 is palmitic acid.,
C18-0 is stearic acid.
C18-1 is oleic acid.
C18-2 is linoleic acid.
C18-3 is linolenic acid.
C22-1 is erucic acid.

TABLE 2

Description of Epoxidized Vegetable Oils

| Name | Description | Oxirane Oxygen (%) | Iodine Value |
|---|---|---|---|
| ESO | epoxidized soybean oil | 7.0 | 1.6 |
| ELO | epoxidized linseed oil | — | — |
| ECO | epoxidized canoloa oil | 5.6 | 4.5 |
| EOTE | epoxidized 2-ethylhexyl tallate | 4.7 | 2.5 |

A variety of standardized test methods were used in the following examples. These test methods included: Pressurized Differential Scanning Calorimetry (PDSC), ASTM D6186; Demulsibility, ASTM D1401; Four-Ball Wear, ASTM D2266; Four-Ball EP, ASTM D4172); Hydrolytic Stability, ASTM D2619; Rotating Bomb Oxidation (RBOT) or Rotating Pressure Vessel Oxidation Test (RPVOT), ASTM D2272; and Turbine Oil Stability Test (TOST), ASTM D943.

A comparison of the stability of various baseline vegetable oils and synthetic esters was measured against their epoxidized oils and this data is presented in Table 3 (Examples 1-9).

TABLE 3

Properties of vegetable oils, epoxidized vegetable oils, synthtic esters, and epoxidized synthetic esters

| | Example | | | | | | | | |
|---|---|---|---|---|---|---|---|---|---|
| | 1 | 2 | 3 | 4 | 5 | 6 | 7 | 8 | 9 |
| | Name | | | | | | | | |
| | HEAR2 | CO3 | CO2 | ECO | ESO | ELO | OTE | POE1 | EOTE |
| | Description | | | | | | | | |
| | rapeseed oil | canola oil | canola oil | canola oil | soybean oil | linseed oil | octyl tallate ester | TMP caprate ester | octyl tallate ester |
| Epoxidized | N | N | N | Y | Y | Y | N | N | Y |
| 18:0 Stearic (%) | 1 | — | 2 | — | 3 | 5 | — | — | — |
| 18:1 Oleic (%) | 13 | 60 | 85 | 60 | 26 | 17 | 28 | — | 28 |
| 18:2 Linoleic (%) | 15 | 20 | 7 | 20 | 51 | 16 | 19 | — | 19 |
| 18:3 Linolenic (%) | 16 | 10 | — | 10 | 5 | 55 | 9 | — | 9 |
| 20:1 Erucic (%) | 51 | — | — | — | — | — | — | — | — |
| Viscosity @ 40 C. (cSt) | 45 | 35 | 44 | — | 161 | 269 | 7.9 | 19.8 | 20 |
| Viscosity @ 100 C. (cSt) | 10 | 8.0 | 9.3 | — | 19.2 | 25.6 | 2.6 | 4.4 | 4.4 |
| Viscosity Index | 213 | 213 | 199 | — | 136 | 123 | 184 | 136 | 134 |
| Molecular Weight | 1000 | 1000 | 1000 | 1000 | 1000 | 1000 | 400 | — | 420 |
| Flash Point, COC (C.) | 310 | 340 | 321 | — | 290 | 290 | 158 | 258 | 220 |
| Pour Point (C.) | −12 | −20 | −12 | — | −3 | −5 | −48 | −57 | −21 |
| % Oxirane Oxygen | — | — | — | — | 7 | 9 | — | — | 4.7 |
| Iodine Value (mgKOH/g) | 106 | 111 | 92 | — | 2 | 3 | — | — | 3 |
| ASTM D1401 Emulsion Characteristics | | | | | | | | | |
| Oil Layer, mL | 40 | 40 | 41 | 0 | 0 | 0 | 40 | 40 | 40 |
| Water layer, mL | 40 | 40 | 39 | 33 | 36 | 0 | 40 | 40 | 40 |
| Emulsion, mL | 0 | 0 | 0 | 47 | 44 | 80 | 0 | 0 | 0 |
| Separation Time, min. | 15 | 15 | 30 | 30 | 30 | 30 | 15 | 20 | 10 |
| ASTM D2619 Hydrolytic Stability | | | | | | | | | |
| Acid Number Change, mgKOH/g | 0.08 | 0.03 | 0.01 | −0.1 | 0.15 | 0.02 | −0.11 | 0.97 | 0.17 |
| Total Acidity of Water, mgKOH | 0.14 | 0.46 | 0.35 | 3.0 | 3.35 | 1.63 | 0.67 | 0.28 | 1.79 |
| Weight Change of Copper Strip, mg/cm2 | −0.04 | 0.0 | 0.0 | −0.1 | 0.0 | 0.0 | −0.1 | 0.0 | −0.1 |
| Appearance of Strip | 1b | 1b | 1a | 2c | 1b | 1b | 1b | 2a | 2a |
| Insolubles, % | 0.02 | 0.06 | 0.05 | 0.14 | 0.07 | 0.56 | 0.03 | 0.0 | 0.07 |
| Viscosity Change @ 40 C., % | −0.88 | 0.92 | 0.64 | −85.15 | −0.69 | 16.49 | 7.03 | 1.27 | 0.93 |
| ASTM D6186 (PDSC) | | | | | | | | | |
| OIT (min) | 16 | 22 | 16 | 6 | 8 | 24 | 6 | 6 | 70 |
| Temperature | 130 | 130 | 130 | 180 | 180 | 155 | 130 | 180 | 155 |
| ASTM D2272 (RPVOT) | | | | | | | | | |
| Bomb Life, (min) | 16 | 18 | 16 | — | 22 | 26 | 15 | 67 | 18 |
| ASTM D943 (TOST) | | | | | | | | | |
| Time to TAN = 2.0 mgKOH/g (h) | <500 | <500 | <500 | — | 1407 | 663 | <500 | <500 | 4119 |
| ASTM D4172 Four Ball Wear Test | | | | | | | | | |
| Test Temperature, C. | 75 | 75 | 75 | — | 75 | 75 | 75 | 75 | 75 |
| Test Duration, hr | 1 | 1 | 1 | — | 1 | 1 | 1 | 1 | 1 |
| Test Load, kg | 1200 | 1200 | 1200 | — | 1200 | 1200 | 1200 | 1200 | 1200 |
| Spindle Speed, rpm | 40 | 40 | 40 | — | 40 | 40 | 40 | 40 | 40 |
| Average Scar Diameter, mm | 0.70 | 0.67 | 0.63 | — | 0.92 | 0.95 | 0.85 | 0.59 | 0.76 |

TABLE 3-continued

Properties of vegetable oils, epoxidized vegetable oils, synthtic esters, and epoxidized synthetic esters

| | Example | | | | | | | | |
|---|---|---|---|---|---|---|---|---|---|
| | 1 | 2 | 3 | 4 | 5 | 6 | 7 | 8 | 9 |
| | Name | | | | | | | | |
| | HEAR2 | CO3 | CO2 | ECO | ESO | ELO | OTE | POE1 | EOTE |
| | Description | | | | | | | | |
| | rapeseed oil | canola oil | canola oil | canola oil | soybean oil | linseed oil | octyl tallate ester | TMP caprate ester | octyl tallate ester |
| ASTM D892 Foaming Tendency | | | | | | | | | |
| Sequence I (5 min blow/10 min settling), ml/ml | 10/0 | 0/0 | 0/0 | — | 130/0 | 590/0 | 0/0 | 0/0 | 40/0 |
| Sequence II (5 min blow/10 min settling), ml/ml | 0/0 | 0/0 | 0/0 | — | 180/0 | 400/0 | 0/0 | 0/0 | 0/0 |
| Sequence III (5 min blow/10 min settling), ml/ml | 0/0 | 0/0 | 0/0 | — | 40/0 | 510/0 | 0/0 | 0/0 | 40/0 |

Examples 1-3

Examples 1-3 demonstrate the poor oxidative stability of the typical vegetable oils (high erucic acid rapeseed oil, canola oil, and high oleic acid canola oil) in PDSC, RPVOT, and TOST testing

Examples 4-6

Examples 4-6 demonstrate the excellent oxidative stability of the typical epoxidized vegetable oils (canola oil, soybean oil, and linseed oil) in PDSC, RPVOT, and TOST testing.

Example 7

Example 7 demonstrates the synthetic ester OTE, based on octyl tallate, is significantly less oxidatively stable in PDSC, RPVOT, and TOST testing than its epoxidized octyl tallate ester analog in Example 9.

Example 8

Example 8 demonstrates another synthetic ester, based on trimethylol propane caprate, is significantly less oxidatively stable in PDSC, RPVOT, and TOST testing than the epoxidized octyl tallate ester in Example 9.

Example 9

Example 9 demonstrates the octyl tallate ester is stable in typical industrial lubricant testing (emulsion characteristics, four-ball wear, foaming tendency, PDSC, RPVOT, and TOST).

A comparative table of the stability of various baseline vegetable oil, epoxidized vegetable oils, esters and epoxidized esters was made in the presence of antioxidant in Table 4 (Examples 10-19)

TABLE 4

Properties of vegetable oils, epoxidized vegetable oils, synthtic esters, and epoxidized synthetic esters with antioxidant

| | Example | | | | | | | | | |
|---|---|---|---|---|---|---|---|---|---|---|
| | 10 | 11 | 12 | 13 | 14 | 15 | 16 | 17 | 18 | 19 |
| CO1 | 100.0 | 99.0 | | | | | | | | |
| CO2 | | | 100.0 | 99.0 | | | | | | |
| ESO | | | | | 100.0 | 99.0 | | | | |
| EOTE | | | | | | | 100.0 | 99.0 | | |
| ECO | | | | | | | | | 100.0 | 99.0 |
| Naugalube 438L | | 1.0 | | 1.0 | | 1.0 | | 1.0 | | 1.0 |
| ASTM D1401 Emulsion Characteristics | | | | | | | | | | |
| Oil Layer, mL | 40 | 43 | 41 | 43 | 0 | 0 | 40 | 43 | 0 | — |
| Water layer, mL | 40 | 37 | 39 | 37 | 36 | 37 | 40 | 37 | 33 | — |
| Emulsion, mL | 0 | 0 | 0 | 0 | 44 | 43 | 0 | 0 | 47 | — |
| Separation Time, min. | 15 | 15 | 30 | 15 | 30 | 15 | 10 | 10 | 30 | — |
| ASTM D2266 Four Ball Wear Test | | | | | | | | | | |
| Test Temperature, C. | 85 | 85 | 85 | 85 | 85 | 85 | 85 | 85 | 85 | — |
| Test Duration, hr | 1 | 1 | 1 | 1 | 1 | 1 | 1 | 1 | 1 | — |
| Test Load, kg | 40 | 40 | 40 | 40 | 40 | 40 | 40 | 40 | 40 | — |
| Spindle Speed, rpm | 1500 | 1500 | 1500 | 1500 | 1500 | 1500 | 1500 | 1500 | 1500 | — |
| Average Scar Diameter, mm | 0.61 | 0.65 | 0.59 | 0.65 | 0.65 | 0.88 | 0.67 | 0.75 | 0.78 | — |

TABLE 4-continued

Properties of vegetable oils, epoxidized vegetable oils, synthtic esters, and epoxidized synthetic esters with antioxidant

| | Example | | | | | | | | | |
|---|---|---|---|---|---|---|---|---|---|---|
| | 10 | 11 | 12 | 13 | 14 | 15 | 16 | 17 | 18 | 19 |
| ASTM D2619 Hydrolytic Stability | | | | | | | | | | |
| Acid Number Change, mgKOH/g | 0.03 | 0 | 0.01 | 0.01 | 0.15 | 0.06 | 0.17 | 0.07 | −0.1 | — |
| Total Acidity of Water, mgKOH | 0.46 | 0.46 | 0.35 | 0.40 | 3.35 | 3.00 | 1.79 | 4.80 | 3.00 | — |
| Weight Change of Copper Strip, mg/cm2 | 0 | 0 | 0 | 0 | 0 | 0 | −0.1 | −0.3 | −0.1 | — |
| Appearance of Strip | 1b | 1b | 1a | 1b | 1b | 1b | 2a | 1b | 2c | — |
| Insolubles, % | 0.06 | 0 | 0.05 | 0.01 | 0.07 | 0.06 | 0.07 | 0.01 | 0.14 | — |
| Viscosity Change @ 40 C., % | 0.92 | 9.79 | 0.64 | 0.49 | −0.69 | 1.07 | 0.93 | −0.27 | −85.15 | — |
| ASTM D6186 PDSC Results | | | | | | | | | | |
| OIT (min) | 7 | 24 | 16 | 29 | 8 | 26 | 70 | 24 | 6 | 15 |
| Temperature | 130 | 130 | 130 | 130 | 180 | 210 | 155 | 210 | 180 | 210 |

Examples 10-11

Examples 10-11 demonstrate the baseline oxidative stability of canola oil (COI) using aminic antioxidant.

Examples 12-13

Examples 12-13 demonstrate the baseline oxidative stability of high oleic acid canola oil (CO2) using aminic antioxidant.

Examples 14-15

Examples 14-15 demonstrate the improved oxidative stability and demulsibility of epoxidized soybean oil (ESO) using aminic antioxidant.

Examples 16-17

Examples 16-17 demonstrate the improved oxidative stability of epoxidized octyl tallate ester (EOTE) using aminic antioxidant.

Examples 18-19

Examples 18-19 demonstrate the improved oxidative stability of epoxidized canola oil (ECO) using aminic antioxidant.

A comparison of the stability of the octyl tallate ester (OTE) and epoxidized octyl tallate ester (EOTE) with various antioxidants, metal passivators, and EP/AW additives is demonstrated in examples 20-32 (Table 5) for application of these products in industrial fluid testing.

TABLE 5

Properties of industrial oil lubricant blends with synthetic esters and epoxidized synthetic esters

| | Example | | | | | | | | | | | | |
|---|---|---|---|---|---|---|---|---|---|---|---|---|---|
| | 20 | 21 | 22 | 23 | 24 | 25 | 26 | 27 | 28 | 29 | 30 | 31 | 32 |
| EOTE | 100.0 | 99.0 | 99.0 | 99.0 | 99.0 | | | 98.95 | 98.95 | 98.75 | 98.75 | | 98.70 |
| OTE | | | | | | 100.0 | 99.0 | | | | | 98.95 | |
| Naugalube 438L | | 1.0 | | | 0.50 | | 0.50 | 0.50 | | 0.50 | | 0.50 | 1.00 |
| Naugalube 531 | | | 1.0 | | | | | | 0.50 | | 0.50 | | |
| Naugalube APAN | | | | 1.0 | | | | | | | | | |
| Metal Passivator | | | | | 0.05 | | 0.05 | 0.05 | 0.05 | 0.05 | 0.05 | 0.05 | 0.05 |
| Calcinate C400CLR | | | | | 0.20 | | 0.20 | | | 0.20 | 0.20 | | |
| ZDDP | | | | | 0.25 | | 0.25 | 0.50 | 0.50 | 0.50 | 0.50 | 0.50 | 0.25 |
| ASTM D1401 Emulsion Characteristics | | | | | | | | | | | | | |
| Oil Layer, mL | 40 | 43 | 40 | 33 | 40 | 40 | 40 | 14 | 16 | 40 | 40 | 42 | 40 |
| Water layer, mL | 40 | 37 | 40 | 36 | 40 | 40 | 40 | 0 | 10 | 37 | 40 | 38 | 40 |
| Emulsion, mL | 0 | 0 | 0 | 11 | 0 | 0 | 0 | 66 | 54 | 3 | 0 | 0 | 0 |
| Separation Time, min. | 10 | 10 | 15 | 40 | 15 | 15 | 5 | 30 | 30 | 25 | 15 | 15 | 30 |
| ASTM D4172 Four Ball Wear Test | | | | | | | | | | | | | |
| Test Temperature, C. | 75 | 75 | 75 | 75 | 75 | 75 | 75 | 75 | 75 | 75 | 75 | 75 | 75 |
| Test Duration, hr | 1 | 1 | 1 | 1 | 1 | 1 | 1 | 1 | 1 | 1 | 1 | 1 | 1 |
| Test Load, kg | 40 | 40 | 40 | 40 | 40 | 40 | 40 | 40 | 40 | 40 | 40 | 40 | 40 |
| Spindle Speed, rpm | 1200 | 1200 | 1200 | 1200 | 1200 | 1200 | 1200 | 1200 | 1200 | 1200 | 1200 | 1200 | 1200 |
| Average Scar Diameter, mm | 0.67 | 0.75 | 1.02 | 0.71 | 0.69 | 0.84 | 0.54 | 0.86 | 0.86 | 0.51 | 0.51 | 0.53 | 0.86 |

TABLE 5-continued

| Properties of industrial oil lubricant blends with synthetic esters and epoxidized synthetic esters | Example | | | | | | | | | | | | |
|---|---|---|---|---|---|---|---|---|---|---|---|---|---|
| | 20 | 21 | 22 | 23 | 24 | 25 | 26 | 27 | 28 | 29 | 30 | 31 | 32 |
| ASTM D6186 PDSC Results | | | | | | | | | | | | | |
| OIT (min) | 70 | 24 | 40 | 72 | 51 | 6 | 22 | 41 | 17 | 42 | 14 | 26 | 52 |
| Temperature | 155 | 210 | 155 | 180 | 180 | 130 | 130 | 180 | 180 | 180 | 180 | 180 | 180 |
| ASTM D2272 Rotating Pressure Vessel Oxidation | | | | | | | | | | | | | |
| Bomb Life, min. | 18 | — | 59 | 376 | 592 | 15 | 15 | 450 | 147 | 507 | 183 | 15 | 458 |

Example 20

Example 20 demonstrates the baseline performance of ethoxylated octyl tallate ester (EOTE) in industrial fluid testing.

Examples 21-24

Examples 21-24 demonstrate the performance of ethoxylated octyl tallate ester (EOTE) with various aminic antioxidants. The oxidative PDSC, hydrolytic stability, and RPVOT are all improved with the addition of antioxidant.

Examples 25-26

Examples 25-26 demonstrate the poor oxidation performance of octyl tallate ester (OTE) compared to the epoxidized analogs (Example 20), but improved PDSC, hydrolytic stability, and RPVOT with the addition of antioxidant.

Examples 27-28

Examples 27-28 demonstrate the performance of ethoxylated octyl tallate ester (EOTE) with metal passivator in typical industrial fluid tests. The PDSC and RPVOT are all synergistically improved with the addition of the metal passivator.

Examples 29-30

Examples 29-30 demonstrate the performance of ethoxylated octyl tallate ester (EOTE) with overbased sulfonate and ZDDP for EP/AW in typical industrial fluid tests. The oxidative stability tests, PDSC and RPVOT, are all synergistically improved with the addition of the overbased sulfonate, as well as, the four-ball wear and emulsion performance.

Examples 31-32

Examples 31-32 demonstrate the performance of octyl tallate ester (OTE) and ethoxylated octyl tallate ester (EOTE) with ZDDP for EP/AW in typical industrial fluid tests. The four-ball wear, PDSC, and RPVOT are all synergistically improved with the addition of the ZDDP.

A comparison of the stability of the epoxidized octyl tallate ester EOTE in a hydraulic fluid formulation with various antioxidants, metal passivators, and EP/AW additives demonstrates the application of these products in typical hydraulic fluid testing in examples 33-40 (Table 6).

TABLE 6

| Properties of hydraulic fluid blends with synthetic esters and epoxidized synthetic esters | Example | | | | | | | |
|---|---|---|---|---|---|---|---|---|
| | 33 | 34 | 35 | 36 | 37 | 38 | 39 | 40 |
| EOTE | 98.75 | 98.75 | 99.05 | 99.05 | 99.05 | 98.8 | 98.85 | 99.05 |
| Naugalube 438L | 0.50 | 0.50 | 0.25 | 0.25 | 0.25 | 0.50 | 0.25 | 0.25 |
| Metal Passivator | 0.05 | 0.05 | 0.05 | 0.05 | 0.05 | 0.05 | 0.05 | 0.05 |
| Calcinate C400CLR | 0.20 | | | | 0.40 | 0.40 | 0.40 | 0.40 |
| Calcinate C300R | | 0.20 | | | | | | |
| Calcinate C400W | | | 0.40 | | | | | |
| OBC | | | | 0.40 | | | | |
| ZDDP | 0.50 | 0.50 | 0.25 | 0.25 | 0.25 | 0.25 | 0.25 | |
| Additin RC 2515 | | | | | | | | 0.25 |
| GMO | | | | | | | 0.20 | |
| ASTM D1401 Emulsion Characteristics | | | | | | | | |
| Oil Layer, mL | 40 | 40 | 0 | 40 | 40 | 40 | 40 | 42 |
| Water layer, mL | 37 | 40 | 0 | 40 | 40 | 40 | 40 | 38 |
| Emulsion, mL | 3 | 0 | 80 | 0 | 0 | 0 | 0 | 0 |
| Separation Time, min. | 25 | 10 | 30 | 15 | 15 | 15 | 20 | 15 |

TABLE 6-continued

Properties of hydraulic fluid blends with synthetic esters and epoxidized synthetic esters

| | Example | | | | | | | |
|---|---|---|---|---|---|---|---|---|
| | 33 | 34 | 35 | 36 | 37 | 38 | 39 | 40 |
| ASTM D4172 Four Ball Wear Test | | | | | | | | |
| Test Temperature, C. | 75 | 75 | 75 | 75 | 75 | 75 | 75 | 75 |
| Test Duration, hr | 1 | 1 | 1 | 1 | 1 | 1 | 1 | 1 |
| Test Load, kg | 40 | 40 | 40 | 40 | 40 | 40 | 40 | 40 |
| Spindle Speed, rpm | 1200 | 1200 | 1200 | 1200 | 1200 | 1200 | 1200 | 1200 |
| Average Scar Diameter, mm | 0.51 | 0.72 | 0.70 | 0.78 | 0.55 | 0.55 | 0.50 | 0.75 |
| ASTM D2619 Hydrolytic Stability | | | | | | | | |
| Acid Number Change, mgKOH/g | −0.34 | −0.36 | 0.17 | 0.14 | −0.25 | −0.24 | 0.21 | 0.07 |
| Total Acidity of Water, mgKOH | 2.13 | 4.38 | 3.53 | 6.06 | 0.11 | 0.11 | 3.09 | 0.17 |
| Weight Change of Copper Strip, mg/cm2 | −0.3 | −0.3 | 0.2 | 0.2 | −0.1 | −0.1 | 0.1 | 0 |
| Appearance of Strip* | 1a | 2a? | 2a | 2a | 1b | 1b | 2a | 1b |
| Insolubles, % | 0.06 | 0.02 | 0.01 | 0.00 | 0.08 | 0.07 | 0.10 | 0.05 |
| Viscosity Change @ 40 C., % | 6.34 | 8.28 | 7.35 | 6.72 | 1.54 | 2.81 | 7.40 | 2.01 |
| ASTM D6186 (PDSC) | | | | | | | | |
| OIT (min) | 42 | 40 | 33 | 43 | 39 | 64 | 21 | 22 |
| Temperature | 180 | 180 | 180 | 180 | 180 | 180 | 180 | 180 |
| ASTM D2272 (RPVOT) | | | | | | | | |
| Bomb Life, min. | 507 | 486 | 490 | 552 | 519 | 519 | 466 | 437 |

*1a - no pitting, etching or scaling, corrosion 1b - no pitting, etching or scaling, moderate tarnish, 2a - no pitting, etching or scaling, dark tarnish

Examples 33-36

Examples 33-36 demonstrate the performance of ethoxylated octyl tallate ester (EOTE) with various overbased detergents and ZDDP for EP/AW in typical hydraulic fluid tests. The emulsion, four-ball wear, hydrolytic stability, PDSC, and RPVOT performance was acceptable for a hydraulic fluid.

Examples 37-38

Examples 37-38 demonstrate the performance of ethoxylated octyl tallate ester (EOTE) with overbased sulfonate and ZDDP for EP/AW in typical hydraulic fluid tests in optimized concentrations. The emulsion, four-ball wear, hydrolytic stability, PDSC, and RPVOT performance was acceptable for a hydraulic fluid.

Example 39

Example 39 demonstrates the performance of ethoxylated octyl tallate ester (EOTE) with overbased sulfonate and ZDDP for EP/AW and GMO for lubricity in typical hydraulic fluid tests in optimized concentrations. The emulsion, four-ball wear, hydrolytic stability, PDSC, and RPVOT performance was acceptable for a hydraulic fluid.

Example 40

Example 40 demonstrates the performance of ethoxylated octyl tallate ester (EOTE) with overbased sulfonate and sulfurized olefin for EP/AW in typical hydraulic fluid tests in optimized concentrations. The emulsion, four-ball wear, hydrolytic stability, PDSC, and RPVOT performance was acceptable for a hydraulic fluid.

The invention has been described in detail with particular reference to preferred embodiments thereof, but it is understood that variations and modifications can be effected within the spirit and scope of the invention.

What is claimed is:

1. A biodegradable industrial fluid comprising an epoxidized tall oil ester comprising an alkyl moiety of one to about eight carbon atoms and at least one antioxidant, wherein said epoxidized tall oil ester is present in an amount ranging from about 70 weight percent to about 99.9 weight percent.

2. The biodegradable industrial fluid of claim 1, wherein said at least one antioxidant is selected from the group consisting of alkylated diphenylamines, N-alkylated phenylenediamines, secondary diarylamines, hindered phenolic compounds, and oil soluble copper compounds.

3. The biodegradable industrial fluid of claim 1, wherein said industrial fluid further comprises additives to improve deposit control, anti-wear, frictional, antioxidant, low temperature, and other properties of said fluid.

4. The biodegradable industrial fluid of claim 3, wherein said additives are selected from the group consisting of dispersants, detergents, rust inhibitors, antiwear agents, antifoamants, friction modifiers, seal swell agents, demulsifiers, VI improvers, and pour point depressants.

5. The biodegradable industrial fluid of claim 3, wherein said additives are in a concentration from about 0.1 to about 30 weight percent.

6. The biodegradable industrial fluid of claim 1, wherein said industrial fluid is hydraulic fluid.

7. A method for improving the oxidation stability of industrial fluids comprising employing as the base oil of said industrial fluid an epoxidized tall oil ester comprising an alkyl moiety of one to about eight carbon atoms, wherein said epoxidized tall oil ester is used in combination with at least one antioxidant, and wherein said epoxidized tall oil ester is present in an amount ranging from about 70 weight percent to about 99.9 weight percent.

8. The method of claim 7, wherein said at least one antioxidant is selected from the group consisting of alkylated diphenylamines, N-alkylated phenylenediamines, secondary diarylamines, hindered phenolic compounds, and oil soluble copper compounds.

9. The method of claim 7, wherein additives are added to said base oil to improve deposit control, anti-wear, frictional, antioxidant, low temperature, and other properties of said fluid.

10. The method of claim 9, wherein said additives are selected from the group consisting of dispers ants, detergents, rust inhibitors, antiwear agents, antifoamants, friction modifiers, seal swell agents, demulsifiers, VI improvers, and pour point depressants.

11. The method of claim 7 wherein the industrial fluid is a hydraulic fluid.

* * * * *